US005538417A

United States Patent [19]

Chan

[11] Patent Number: 5,538,417

[45] Date of Patent: Jul. 23, 1996

[54] CIGARETTE LIGHTERS

[75] Inventor: Leung Chan, New Territories, Hong Kong

[73] Assignee: Cli-Claque Company Ltd., Hong Kong

[21] Appl. No.: 266,562

[22] Filed: Jun. 28, 1994

[51] Int. Cl.[6] ..... F23D 11/36

[52] U.S. Cl. ..... 431/153; 431/255

[58] Field of Search ..... 431/153, 255

[56] References Cited

U.S. PATENT DOCUMENTS

| | | | |
|---|---|---|---|
| D. 291,493 | 8/1987 | Endelson . | |
| 4,517,994 | 5/1985 | Endelson . | |
| 4,595,352 | 6/1986 | Endelson . | |
| 4,786,248 | 11/1988 | Nitta | 431/255 |
| 4,830,603 | 5/1989 | Cirami . | |
| 4,832,596 | 5/1989 | Morris, Sr. . | |
| 4,921,420 | 5/1990 | Johnston . | |
| 5,002,482 | 3/1991 | Fairbanks . | |
| 5,074,781 | 12/1991 | Fujita . | |
| 5,120,215 | 6/1992 | Amoros Nollas . | |
| 5,165,885 | 11/1992 | Iwahori . | |
| 5,165,886 | 11/1992 | Frigiere . | |
| 5,197,870 | 3/1993 | Yang . | |
| 5,213,493 | 5/1993 | Iwahori . | |
| 5,215,458 | 6/1993 | Cirami . | |
| 5,288,226 | 2/1994 | Khemarangsan . | |

FOREIGN PATENT DOCUMENTS

| | | |
|---|---|---|
| 0546373 | 6/1993 | European Pat. Off. . |
| WO90/00239 | 1/1990 | WIPO . |

*Primary Examiner*—Carroll B. Dority
*Attorney, Agent, or Firm*—Pollock, Vande Sande & Priddy

[57] ABSTRACT

An ultra-thin cigarette lighter is disclosed. It operates by acting on a push button which opens a valve to release gas from a tank and activate a sparking means for igniting the released gas. The lighter has a "self-retrieving" safety mechanism which is simple and easy for an adult to operate and which can reliably prevent unintentional operation of the lighter, such as by a child. The safety mechanism has an elongated resilient bar provided at one end with an operating member located within a slot in the lighter push button. The safety mechanism has a normal position in which the safety device prevents operation of the push button and an operating position, to which the safety device can be moved by an operating member, in which the push button can be operated. Upon operation, the safety device automatically returns to its normal position.

28 Claims, 4 Drawing Sheets

CIGARETTE LIGHTERS

The present invention relates to a cigarette lighter and in particular to an ultra-thin cigarette lighter with a "self-retrieving" safety mechanism whereby accidental operation of the lighter, particularly by a young child, is prevented.

BACKGROUND TO THE INVENTION

Re-fillable, ultra-thin lighters are known and their operation involves a straight forward push button action to open a valve, release gas from a tank and ignite the gas by means of a spark. However, such lighters are not provided with self-retrieving safety mechanisms as is now required by law.

BRIEF SUMMARY OF THE INVENTION

It is an object of the present invention to provide an ultrathin cigarette lighter with a self-retrieving safety mechanism which is simple and easy for an adult user to operate and which can reliably prevent unintentional use of the lighter.

In accordance with the invention there is provided an ultra-thin cigarette lighter comprising

- a tank for a combustible gas under pressure;
- a valve which is normally closed to prevent gas from exiting the tank, but which can be opened to allow gas to escape from the tank through a nozzle;
- a valve actuator operable to open the valve;
- a spark means operable to produce a spark in the vicinity of the nozzle and cause ignition of gas escaping from the tank when the valve is opened by the valve actuator;
- a push button operable by engagement of a user's finger to operate the valve actuator, open the valve and operate said spark means, and
- a movable safety device in the form of an elongated resilient bar provided at one end with an operating member and located in a slot in the push button, said safety device having a normal position, in which the safety device prevents operation of the push button, and an operating position, to which the safety device can be moved by means of the operating member and in which the push button can be operated, the safety device automatically returning to its normal position after use of the cigarette lighter.

BRIEF DESCRIPTION OF THE DRAWINGS

The present invention will be described, by way of example, with reference to the accompanying drawings, in which:

FIG. 6 is a partial view of the cigarette lighter from above with the windshield removed and with the push button pushed in.

As shown in FIG. 1, the cigarette lighter of the present invention comprises a gas tank 4, a body 3 united to the tank 4 by ultra-sonic welding, and a windshield 5 mounted on the body 3. The cigarette lighter is provided with a flame control means 6 and an operating push button 15.

In FIGS. 1 and 2, the cigarette lighter and safety device 1 are shown in normal, non-operating position. The safety device is an elongated resilient bar mainly located in a recess **9*b* (see FIG. 3) in a piezo holder 9 with the operating member 1*a* thereof extending upwardly from a slot 2 in push button 15. The distance between the windshield 5 and the end of that portion of slot 2 occupied by the resilient bar when in normal position is sufficient only to accommodate operating member 1*a*. That is, the operating member obstructs movement of push button 15 towards windshield 5. Thus, operation of the push button is prevented by the operating member 1*a***.

Also illustrated in FIG. 2 is piezo unit 13. One of its ends is mounted in the push button 15 and it also has an electrode 12 which is mounted in the piezo holder 9. Mounted in push button 15 is one end of a reciprocating valve actuator 11. As shown in FIG. 7, the other end of actuator 11 cooperates, when push button 15 is pushed in, with a valve 10. The valve has a substantially U-shaped metal plate 8, which cooperates with valve actuator 11 for urging the stem of the valve upward opening the valve and discharging gas through nozzle 14 which is surrounded by spring 7. When closed, valve 10 prevents gas from exiting tank 4.

Figure 1:
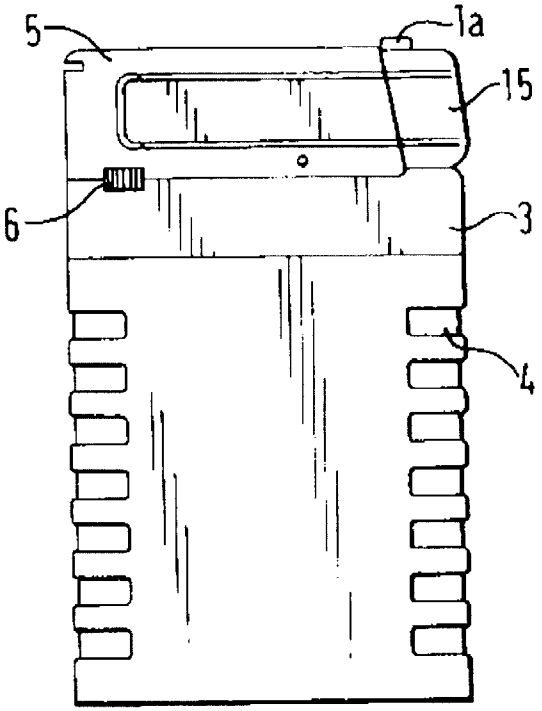
FIG. 1 is a side view of a cigarette lighter in accordance with the present invention.
Figure 3:
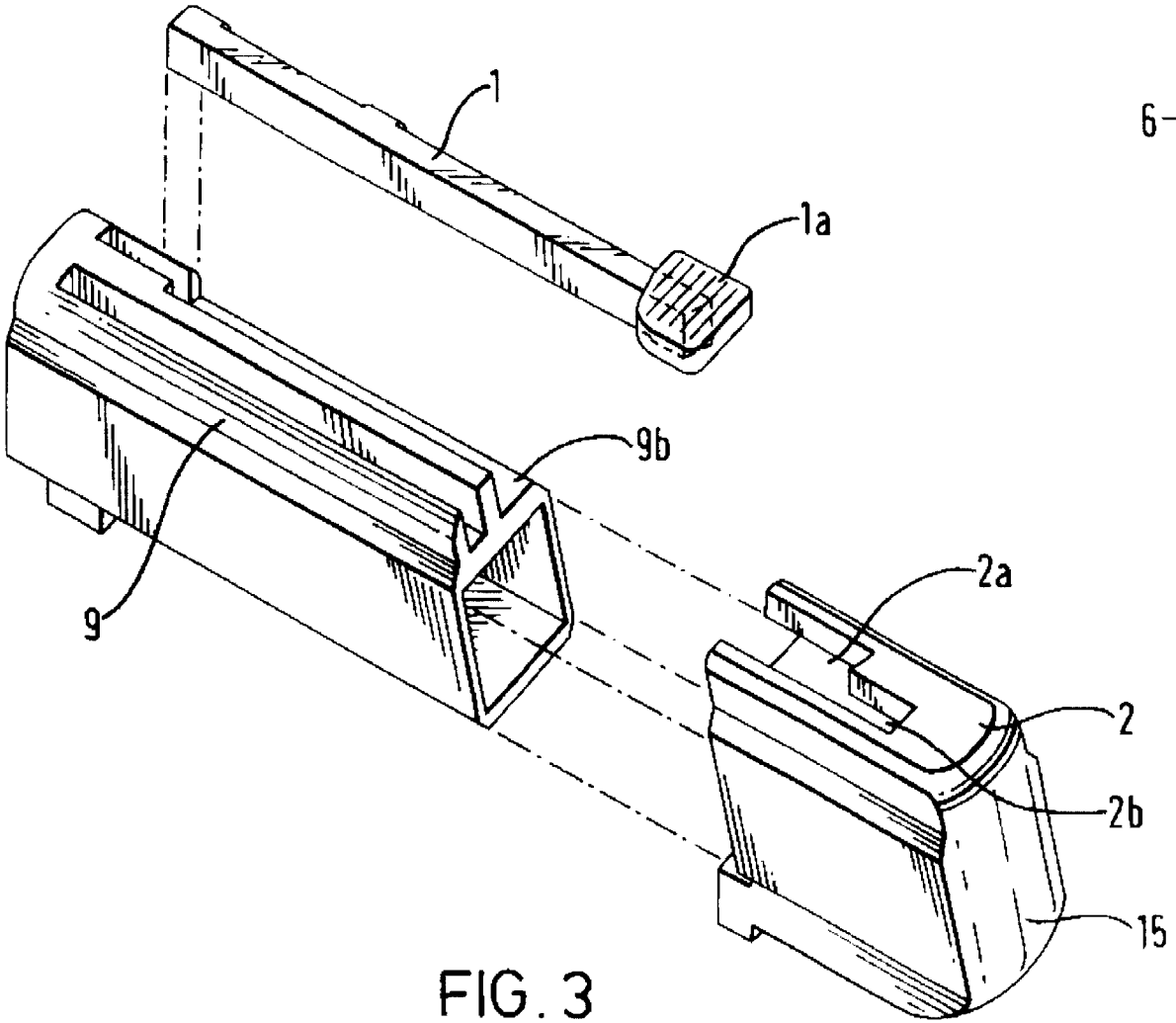
FIG. 3 is an exploded perspective view of part of the cigarette lighter of FIG. 1.
Figure 2:
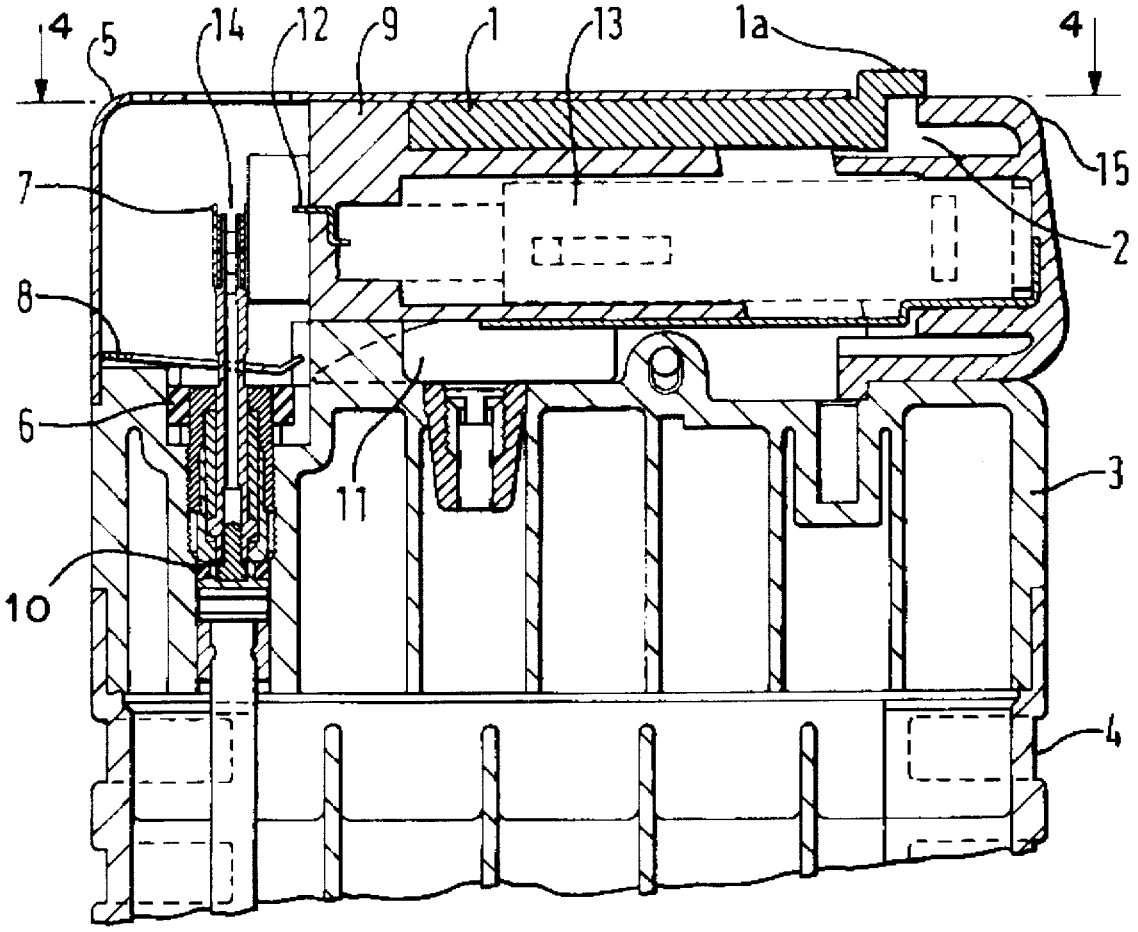
FIG. 2 is a vertical section through the cigarette lighter of FIG. 1 with the safety device and lighter in normal, non-operating position.

The configuration of safety device 1, the push button 15 and the piezo holder 9 are shown in greater detail in FIG. 3, an exploded perspective view. The elongated bar 1 is made of resilient or elastic material such as plastic and is provided at one end with an operating member **1*a*. The push button 15 is provided with a stepped slot 2 comprising two portions 2*a* and 2*b* which are relatively shorter and longer than one another. The piezo holder 9 is provided with a recess 9*b* which accommodates a portion of the safety device 1. Operating member 1*a* of the safety device 1, when in its normal position, is located in portion 2*a* of slot 2. In its operating position the safety device is moved from portion 2*a* to portion 2*b* of the slot 2. However, after operation of the lighter, the safety device returns under its own resilience to portion 2*a* of the slot 2**.

Figure 4:
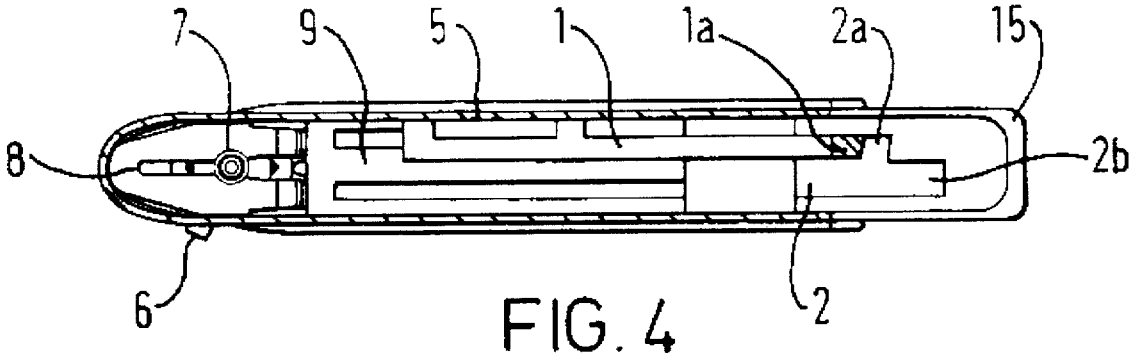
FIG. 4 is a sectional view in the direction of lines 4—4 of FIG. 2 with the windshield removed and with the safety device in normal position.
Figure 5:
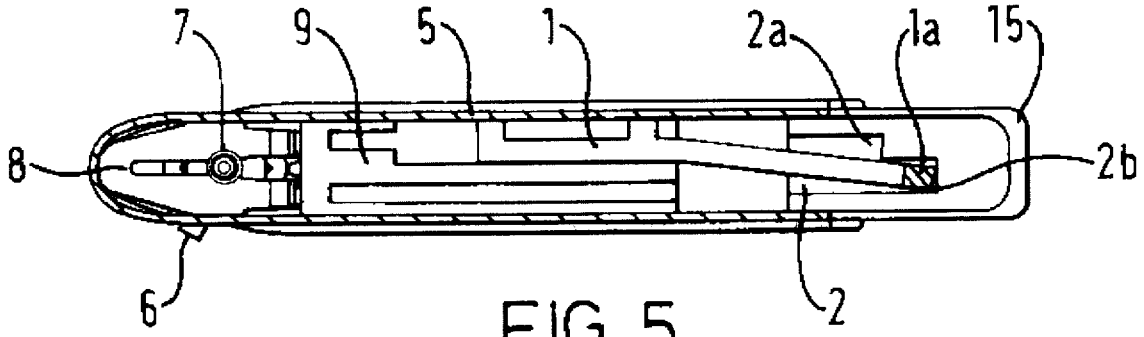
FIG. 5 is a sectional view in the direction of lines 4—4 of FIG. 2 with the windshield removed and with the safety device in a position such that the lighter is operable.
Figure 6:
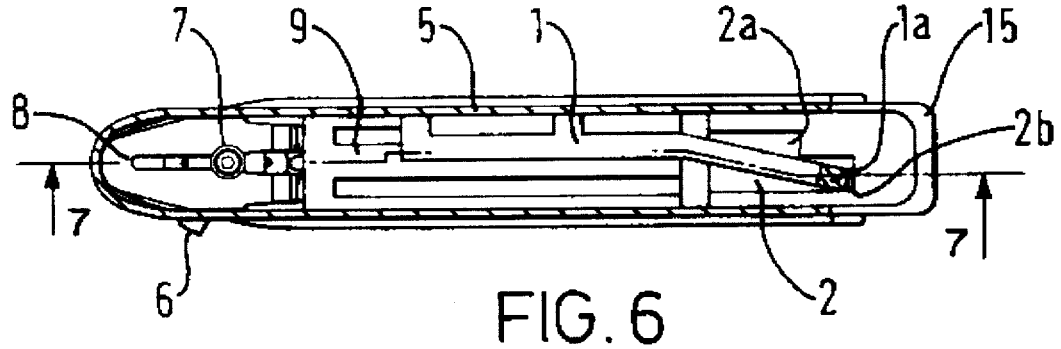

FIGS. 4 to 6 illustrate the different positions of the safety device 1 and other features of the lighter as the lighter is transformed from non-operating to operating mode.

In FIG. 4, the lighter is in a normal, non-operating mode, with the operating member **1*a* of the safety device 1 located in the short portion 2*a* of the slot 2. It can be readily seen from FIG. 4 that push button 15 can only be pushed a very short distance before its further movement is prevented by operating member 1*a***.

In order to permit push button 15 to be fully pushed into the windshield 5, the user must move the operating member **1*a* of the safety device 1 from portion 2*a* to portion 2*b* of slot 2. As shown in FIG. 5, portion 2*b* of the slot 2 is sufficiently long to accommodate the relative movement of the safety device 1 within slot 2 as the push button 15 is pushed into the windshield 5**.

Figure 7:
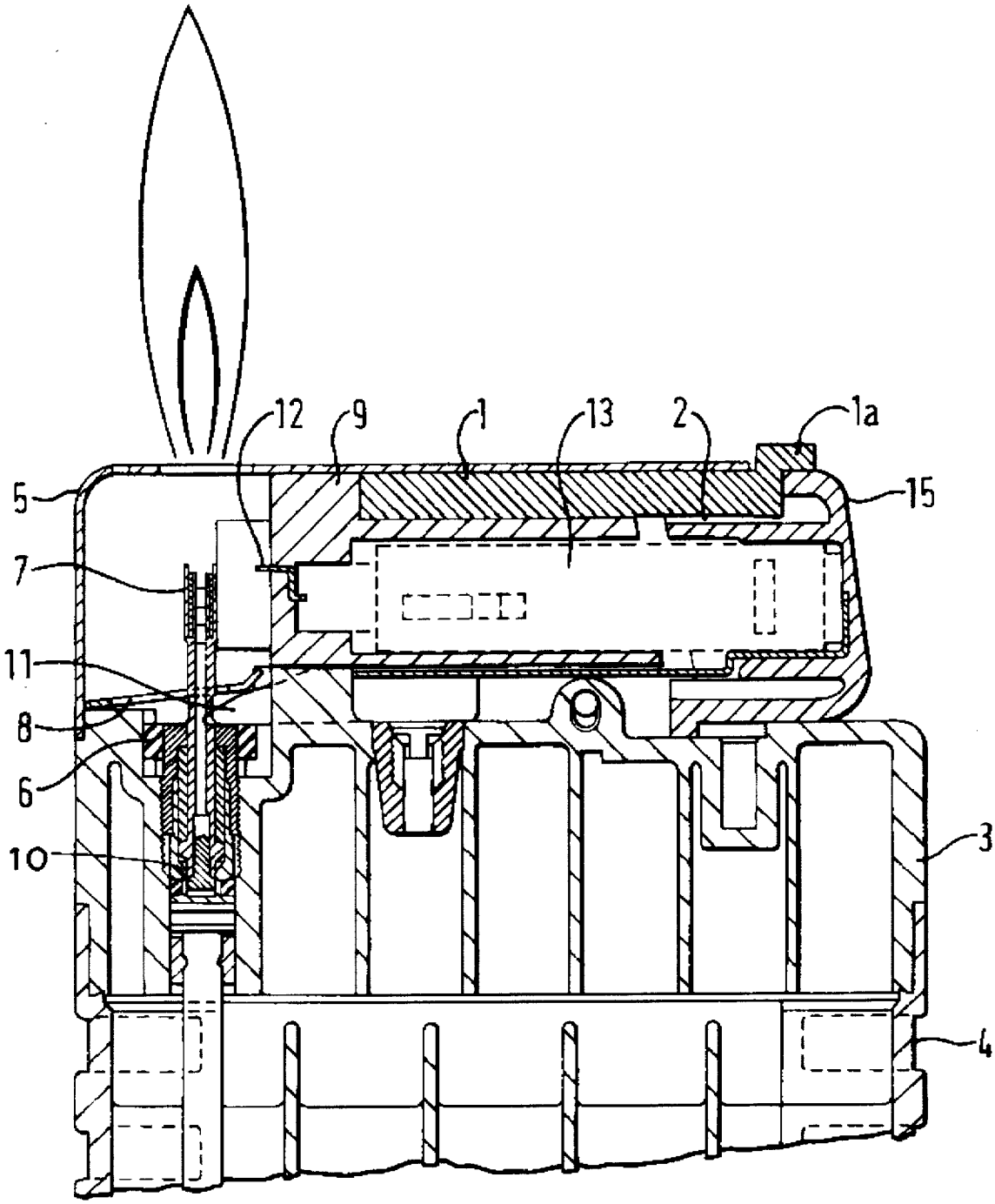
FIG. 7 is a vertical section through the cigarette lighter of FIG. 1 in the direction of lines 7—7 of FIG. 6 with the windshield in place and with both the safety device and lighter in operating position.

FIGS. 6 and 7 show the situation after the operating member 1*a* has been moved to portion 2*b* of the slot 2 and push button 15 has been pushed into the windshield 5. Operation of push button 15 causes the valve actuator 11 to engage the under side of the U-shaped plate 8 of valve 10, urging the stem of the valve upwardly to release gas from the tank 4. Piezo unit 13 is simultaneously compressed and emits sparks from the electrode 12. These ignite gas around the spring 7 of nozzle 14 and generate a flame.

Thus, as may be seen from the drawings and the above text, the invention includes a number of new combinations of features. For example, the invention contemplates cigarette lighters as described in the above Summary of the Invention wherein the valve includes a substantially U-shaped metal plate having up-turned ends to engage with the valve actuator;

the valve actuator is an elongated metal bar, one end of which is fixed into the push button and the other end of which is shaped to engage the under sides of the up-turned ends of the metal plate;

the spark means is a piezo means, one end of which is located in the push button;

the piezo means includes a piezo holder provided with an electrode and a piezo body movably located in said holder;

the piezo holder has a recess in which a portion of the resilient bar of the safety device, longitudinally spaced from said one end, is mounted for reciprocating motion in, and in sliding contact with, the recess;

the slot in the push button includes relatively shorter and longer slot portions, the said one end of the resilient bar is located, in its normal and operating positions respectively, in the shorter and longer slot portions, and the resilient bar is movable into the longer slot portion through user manipulation of the operating member;

the slot in the push button is of stepped configuration to define the relatively shorter and longer slot portions;

the resilient bar has a second end mounted for reciprocation in, and in sliding contact with, a recess within the lighter, and the shorter and longer slot portions are respectively in substantial alignment with and laterally offset from the longitudinal axis of the recess;

the resilient bar is bendable by the user from its normal position in the shorter slot into its operating position in the longer slot, and the resilience of the bent bar urges the bar toward its normal position;

the lighter includes a windscreen covering an upper portion of the lighter; and the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface;

the lighter includes a windscreen covering an upper portion of the lighter and the safety device, when in its normal position, causes conflict between the operating member and the windscreen upon attempted operation of the lighter, thus preventing the push button from operating the valve actuator and spark means; and the slot is formed in an upper portion of the push button and opens through the push button upper surface;

A latitude of modification, change and substitution is intended in the foregoing disclosure and accordingly, it is appropriate that the appended claims be construed broadly and in a manner consistent with the spirit and scope of the invention herein.

I claim:

1. An ultra-thin cigarette lighter comprising a tank for a combustible gas under pressure;

a valve which is normally closed to prevent gas from exiting the tank, but which can be opened to allow gas to escape from the tank through a nozzle;

a valve actuator operable to open the valve;

a spark means operable to produce a spark in the vicinity of the nozzle and cause ignition of gas escaping from the tank when the valve is opened by the valve actuator;

a push button operable by engagement of a user's finger to operate the valve actuator, open the valve and operate said spark means, and a movable safety device in the form of an elongated resilient bar provided at one end with an operating member and located in a first short portion of a slot of a first length in the push button, said safety device having a normal position, in which the safety device prevents operation of the push button by engaging an end portion of said first slot portion, and an operating position, to which the safety device can be moved by means of the operating member into a second slot portion in said push button of a longer length than said first slot portion and in which the push button can be operated, the safety device automatically returning to its normal position after use of the cigarette lighter.

2. A cigarette lighter as claimed in claim 1 wherein the valve includes a substantially U-shaped metal plate having upturned ends to engage with the valve actuator.

3. A cigarette lighter as claimed in claim 2 wherein the valve actuator is an elongated metal bar, one end of which is fixed into the push button and the other end of which is shaped to engage the under sides of the up-turned ends of the metal plate.

4. A cigarette lighter as claimed in claim 1 wherein the spark means is a piezo means, one end of which is located in the push button.

5. A cigarette lighter as claimed in claim 4 wherein the piezo means includes a piezo holder provided with an electrode and a piezo body movably located in said holder.

6. A cigarette lighter as claimed in claim 5 wherein the piezo holder has a recess in which a portion of the resilient bar of the safety device, longitudinally spaced from said one end, is mounted for reciprocating motion in, and in sliding contact with, the recess.

7. A cigarette lighter as claimed in claim 1 wherein the slot in the push button is of stepped configuration to define the relatively shorter and longer slot portions.

8. A cigarette lighter as claimed in claim 1 wherein the resilient bar has a second end mounted for reciprocation in, and in sliding contact with, a recess within the lighter, and the shorter and longer slot portions are respectively in substantial alignment with and laterally offset from the longitudinal axis of the recess.

9. A cigarette lighter as claimed in claim 1 wherein the resilient bar is bendable by the user from its normal position in the shorter slot into its operating position in the longer slot, and the resilience of the bent bar urges the bar toward its normal position.

10. A cigarette lighter as claimed in claim 1 wherein the lighter includes a windscreen covering an upper portion of the lighter; and the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface.

11. A cigarette lighter as claimed in claim 1 wherein the lighter includes a windscreen covering an upper portion of the lighter and the safety device, when in its normal position, causes conflict between the operating member and the windscreen upon attempted operation of the lighter, thus preventing the push button from operating the valve actuator and spark means.

12. A cigarette lighter as claimed in claim 1 wherein the lighter includes a windscreen covering an upper portion of the lighter; the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface; and the safety device, when in its normal position, causes conflict between the operating member and the windscreen upon attempted operation of the lighter, thus preventing the push button from operating the valve actuator and spark means.

13. A cigarette lighter as claimed in claim 1 wherein the slots open through the push button upper surface.

14. A cigarette lighter as claimed in claim 1 wherein the lighter includes a windscreen covering an upper portion of the lighter; and the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface.

15. A cigarette lighter as claimed in claim 1 wherein the lighter includes a windscreen covering an upper portion of the lighter and the safety device, when in its normal position, causes conflict between the operating member and the windscreen upon attempted operation of the lighter, thus preventing the push button from operating the valve actuator and spark means.

16. A cigarette lighter as claimed in claim 1 wherein the lighter includes a windscreen covering an upper portion of the lighter; the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface; and the safety device, when in its normal position, causes conflict between the operating member and the windscreen upon attempted operation of the lighter, thus preventing the push button from operating the valve actuator and spark means.

17. A cigarette lighter as claimed in claim 8 wherein the lighter includes a windscreen covering an upper portion of the lighter; and the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface.

18. A cigarette lighter as claimed in claim 8 wherein the lighter includes a windscreen covering an upper portion of the lighter and the safety device, when in its normal position, causes conflict between the operating member and the windscreen upon attempted operation of the lighter, thus preventing the push button from operating the valve actuator and spark means.

19. A cigarette lighter as claimed in claim 8 wherein the lighter includes a windscreen covering an upper portion of the lighter; the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface; and the safety device, when in its normal position, causes conflict between the operating member and the windscreen upon attempted operation of the lighter, thus preventing the push button from operating the valve actuator and spark means.

20. A cigarette lighter as claimed in claim 8 wherein the slot portions open through the push button upper surface.

21. A cigarette lighter as claimed in claim 9 wherein the lighter includes a windscreen covering an upper portion of the lighter; and the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface.

22. A cigarette lighter as claimed in claim 9 wherein the lighter includes a windscreen covering an upper portion of the lighter and the safety device, when in its normal position, causes conflict between the operating member and the windscreen upon attempted operation of the lighter, thus preventing the push button from operating the valve actuator and spark means.

23. A cigarette lighter as claimed in claim 9 wherein the lighter includes a windscreen covering an upper portion of the lighter; the push button has a first end positioned within the windscreen, has a second end extending from an open end of the wind screen, includes a finger-contacting surface on the second end, and is mounted for horizontal reciprocation in an open end of the windscreen through user manipulation of the finger contacting surface; and the safety device, when in its normal position, causes conflict between the operating member and the windscreen upon attempted operation of the lighter, thus preventing the push button from operating the valve actuator and spark means.

24. A cigarette lighter as claimed in claim 9 wherein the slot portions open through the push button upper surface.

25. An ultra-thin cigarette lighter comprising a tank for a combustible gas under pressure;

a valve which is normally closed to prevent gas from exiting the tank, but which can be opened to allow gas to escape from the tank through a nozzle;

a valve actuator operable to open the valve;

a spark means operable to produce a spark in the vicinity of the nozzle and cause ignition of gas escaping from the tank when the valve is opened by the valve actuator;

a windscreen covering an upper portion of the lighter;

a push button operable by engagement of a user's finger to operate the valve actuator, open the valve and operate said spark means, the push button having a first end positioned within the windscreen, having a second end extending from an open end of the wind screen, including a finger-contacting surface on the second end, and being mounted for horizontal reciprocation in an open end of the windscreen through user manipulation of the finger contacting surface; and a movable safety device in the form of an elongated resilient bar provided at one end with an operating member and located within a slot in the push button, said slot including relatively shorter and longer slot portions, the said one end of the resilient bar being located, in its normal and operating positions respectively, within the shorter and longer slot portions, the resilient bar having a second end mounted for reciprocation in, and in sliding contact with, a recess within the lighter, the shorter and longer slot portions being respectively in substantial alignment with and laterally offset from the longitudinal axis of the recess, the safety device, when in its normal position, causing conflict between the operating member and the windscreen upon attempted operation of the lighter, thus preventing the push button from operating the valve actuator and spark means, the resilient bar being bendable by the user from its normal position in the shorter slot into its operating position in the longer slot, and the resilience of the bent bar being operable to urge the bar toward its normal position, whereby the safety device automatically returns to its normal position after use of the cigarette lighter.

26. A cigarette lighter as claimed in claim 25 wherein the slot is formed in an upper portion of the push button and opens through the push button upper surface.

27. A cigarette lighter as claimed in claim 25 wherein the slot in the push button is of stepped configuration to define the relatively shorter and longer slot portions.

28. A cigarette lighter as claimed in claim 25 wherein the resilient bar is movable into the longer slot portion through user manipulation of the operating member.

* * * * *